US011538307B1

(12) United States Patent
Lever

(10) Patent No.: US 11,538,307 B1
(45) Date of Patent: Dec. 27, 2022

(54) SYSTEMS AND METHODS FOR REMOTE GAMEPLAY MANAGEMENT

(71) Applicant: Kathryn S. Lever, Las Vegas, NV (US)

(72) Inventor: Kathryn S. Lever, Las Vegas, NV (US)

( * ) Notice: Subject to any disclaimer, the term of this patent is extended or adjusted under 35 U.S.C. 154(b) by 0 days.

(21) Appl. No.: 17/343,713

(22) Filed: Jun. 9, 2021

Related U.S. Application Data

(60) Provisional application No. 63/037,360, filed on Jun. 10, 2020.

(51) Int. Cl.
*G07F 17/32* (2006.01)

(52) U.S. Cl.
CPC ..... *G07F 17/3239* (2013.01); *G07F 17/322* (2013.01); *G07F 17/3223* (2013.01)

(58) Field of Classification Search
CPC . G07F 17/3239; G07F 17/322; G07F 17/3223
See application file for complete search history.

(56) References Cited

U.S. PATENT DOCUMENTS

2003/0003997 A1* 1/2003 Vuong ..... G07F 17/3239 463/42
2004/0023722 A1* 2/2004 Vuong ..... G07F 17/3241 463/40
2008/0200257 A1* 8/2008 Stelzer ..... G07F 17/3241 463/42
2019/0033858 A1* 1/2019 Wang ..... G06F 3/0484
2019/0156623 A1* 5/2019 Thomas ..... G07F 17/3237

OTHER PUBLICATIONS

Proxy Gaming, 2018, Gaming Laboratories International, downloaded from <<https://web.archive.org/web/20181201005225/https://gaminglabs.com/services/igaming/proxy-gaming/>>. (Year: 2018).*

* cited by examiner

*Primary Examiner* — Werner G Garner
(74) *Attorney, Agent, or Firm* — Ulmer & Berne LLP

(57) ABSTRACT

Systems and methods are provided that facilitate various types of live casino gameplay for a player that is not physically present at the gaming table. Players can participate in the live gameplay via a computing device at their home, in the casino hotel, or any other suitable location. One or more cameras are positioned proximate to the table game that provide a live video stream for the player to view on their computing device. A delegate of the player is physically present at the table game and interacting with casino personnel running the table game. Real-time communication is facilitated between the delegate and the player. The player provides instructions to the delegate and the delegate carries out the instructions at the table game in real-time.

20 Claims, 6 Drawing Sheets

SYSTEMS AND METHODS FOR REMOTE GAMEPLAY MANAGEMENT

CROSS-REFERENCE TO RELATED APPLICATIONS

This application claims the benefit of U.S. Ser. No. 63/037,360 filed on Jun. 10, 2020, entitled SYSTEMS AND METHODS FOR REMOTE GAMEPLAY MANAGEMENT, the disclosure of which is incorporated herein by reference in its entirety.

BACKGROUND

Casino operators often seek additional ways for players to engage in gaming activities. Due to various operational circumstances, however, operators may be limited with regard to the number of players that may be on their gaming floor or that may occupy any table game. Additionally, while players may want to play at live table games, some players may not be able to travel to a casino or may not desire to do so. Consequently, it would be beneficial to provide systems and methods for allowing players to enjoy the experience of playing a live table game, without needing the player to be physically on the gaming floor.

BRIEF DESCRIPTION OF THE DRAWINGS

It is believed that certain embodiments will be better understood from the following description taken in conjunction with the accompanying drawings, in which like references indicate similar elements and in which.

DETAILED DESCRIPTION

Figure 1:
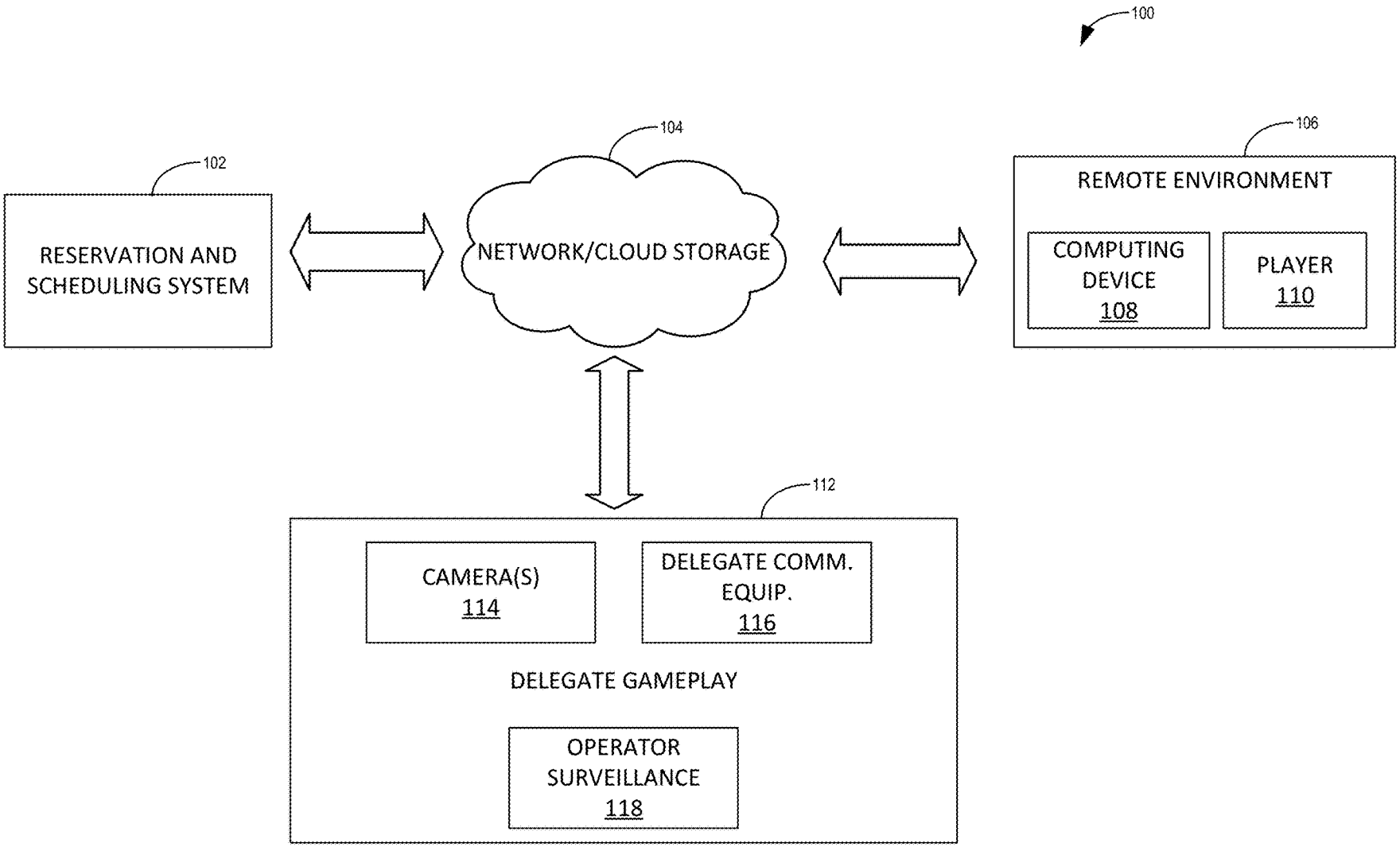
FIG. 1 is a block diagram providing an example schematic overview of the present disclosure in accordance with one non-limiting embodiment.

Various non-limiting embodiments of the present disclosure will now be described to provide an overall understanding of the principles of the structure, function, and use of systems, apparatuses, devices, and methods disclosed. One or more examples of these non-limiting embodiments are illustrated in the selected examples disclosed and described in detail with reference made to FIGS. 1-9 in the accompanying drawings. Those of ordinary skill in the art will understand that systems, apparatuses, devices, and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

The systems, apparatuses, devices, and methods disclosed herein are described in detail by way of examples and with reference to the figures. The examples discussed herein are examples only and are provided to assist in the explanation of the apparatuses, devices, systems and methods described herein. None of the features or components shown in the drawings or discussed below should be taken as mandatory for any specific implementation of any of these apparatuses, devices, systems or methods unless specifically designated as mandatory. For ease of reading and clarity, certain components, modules, or methods may be described solely in connection with a specific figure. In this disclosure, any identification of specific techniques, arrangements, etc. are either related to a specific example presented or are merely a general description of such a technique, arrangement, etc. Identification of specific details or examples is not intended to be, and should not be, construed as mandatory or limiting unless specifically designated as such. Any failure to specifically describe a combination or sub-combination of components should not be understood as an indication that any combination or sub-combination is not possible. It will be appreciated that modifications to disclosed and described examples, arrangements, configurations, components, elements, apparatuses, devices, systems, methods, etc. can be made and may be desired for a specific application. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented, but instead may be performed in a different order or in parallel.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment, or "in an embodiment" in places throughout the specification are not necessarily all referring to the same embodiment. Furthermore, the particular features, structures or characteristics may be combined in any suitable manner in one or more embodiments.

Throughout this disclosure, references to components or modules generally refer to items that logically can be grouped together to perform a function or group of related functions. Like reference numerals are generally intended to refer to the same or similar components. Components and modules can be implemented in software, hardware, or a combination of software and hardware. The term "software" is used expansively to include not only executable code, for example machine-executable or machine-interpretable instructions, but also data structures, data stores and computing instructions stored in any suitable electronic format, including firmware, and embedded software. The terms "information" and "data" are used expansively and include a wide variety of electronic information, including executable code; content such as text, video data, and audio data, among others; and various codes or flags. The terms "information," "data," and "content" are sometimes used interchangeably when permitted by context. It should be noted that, although for clarity and to aid in understanding, some examples discussed herein might describe specific features or functions as part of a specific component or module, or as occurring at a specific layer of a computing device (for example, a hardware layer, operating system layer, or application layer), those features or functions may be implemented as part of a different component or module or operated at a different layer of a communication protocol stack. Those of ordinary skill in the art will recognize that the systems, apparatuses, devices, and methods described herein can be applied to, or easily modified for use with, other types of equipment, can use other arrangements of computing systems, and can use other protocols, or operate at other layers in communication protocol stacks, than are described.

As described in more detail below, the present disclosure generally relates to the facilitating of various types of live casino gameplay for a player that is not physically present at the gaming table. Instead, the player can participate in the live gameplay via any suitable computing device having computer and/or data network communication capabilities, including the Internet, LANs WANs, GPRS networks, etc., that can comprise wired and/or wireless communication links. In this regard, the player can be, for example, at their home, in the casino hotel, or any other suitable location. In some embodiments, however, the player must be physically located within the same gaming jurisdiction as the casino, or otherwise be physically located within an authorized gaming jurisdiction, to comply with various Federal and State statutes and underlying regulations. Accordingly, the geolocation of the player's computing device can be detected and monitored to ensure compliance with the relevant statutes and regulations. One or more cameras can be positioned proximate to the table game and the player's computing device can display a live video stream of the table game. By viewing the camera feed, the player can watch gameplay in real-time. As described below, a delegate of the player can be physically present at the table game and interacting with casino personnel running the table game, such as a dealer or multiple dealers, for example. In some embodiments, for example, the delegate is an employee of the operator of the casino, but this disclosure is not so limited. The delegate can be in real-time communication with the player through any suitable communication device. In one embodiment, for example, the delegate can wear a headset that includes an earpiece and a microphone. The player can provide oral instructions to the delegate, as spoken into the player's computing device, for example, and the delegate can hear the instructions through the earpiece. The delegate can confirm receipt of the instructions by, for example, repeating the instructions aloud into the microphone for transmission to the player's computing device. It is to be appreciated, however, that alternative or additional techniques can be used to allow for real-time communication between the delegate and the player. Therefore, in accordance with the present disclosure, the remote player can watch the gameplay in real-time via a live video feed of a table game, determine their gaming instruction, provide the gaming instruction to the delegate at table game, receive confirmation of the instruction from the delegate, and view the instruction being carried out by the delegate.

Referring now to FIG. 1, a block diagram 100 provides an example schematic overview of the present disclosure. As shown, a reservation and scheduling system 102 can be used to schedule gameplay at a table game. In some embodiments, the reservation and scheduling system 102 bears the branding of the operator of the casino. Any suitable technique can be used by a player 110 to make a reservation onto the scheduling system 102, such as, via phone, via a website, via a mobile application, via an intermediary, and so forth. Generally, the reservation can indicate the type of game, the table limit, and the start time of the gaming session. As shown, the player 110 can be in a remote environment 106 and interacting with a computing device 108.

At the beginning of the gaming session, for example, the player 110 can access an operator branded "lobby" via a player interface on the computing device 108. The physical location of the computing device 108 can be determined by any suitable geolocation technique, as may be necessary. The player 110 can check-in to their reservation using any number of suitable identification checks, such as, for example, a dual-factor ID check, a device fingerprint check, a device biometric check, and/or other types of identification verification techniques. Subsequent to checking into their reservation, a video stream, or other communication connection, can be established between the computing device 108 and delegate gameplay 112 at a table game within a casino environment. In some example embodiments, the communication connection includes an encrypted VOIP video stream established between the delegate gameplay 112 and the computing device 108, although this disclosure is not so limited. Any number of cameras 114 can be used to capture the gameplay using video, such as one camera for the view of the delegate's hand and another camera for a view of the table game from the delegate's perspective. Such cameras 114 can be temporarily positioned proximate to the table game during the gaming session. As shown, the operator can have additional surveillance 118, such as ceiling mounted and/or table mounted cameras. The delegate can wear, or otherwise operate, communication equipment 116 that can allow for real-time two-way communication between the delegate and the player 110. In one example embodiment, the communication equipment 116 includes an encrypted wireless VOIP headset. During gameplay, an encrypted VOIP video stream as well as an encrypted audio connection can be provided to the player 110. The audio connection can be, for example, an encrypted VOIP WiFi phone connection. Once game play terminates, all communications connections between the computing device 108 and the delegate communication equipment 116 can be terminated. For a period of time subsequent to the gameplay session, the audio and video of the gameplay can be stored in cloud storage 104 or other suitable repository. Such stored data can be used for dispute management, audit purposes, regulatory compliance, and so forth. In some embodiments, the data is stored for two years, 5 years, or more, for example.

Figure 2:
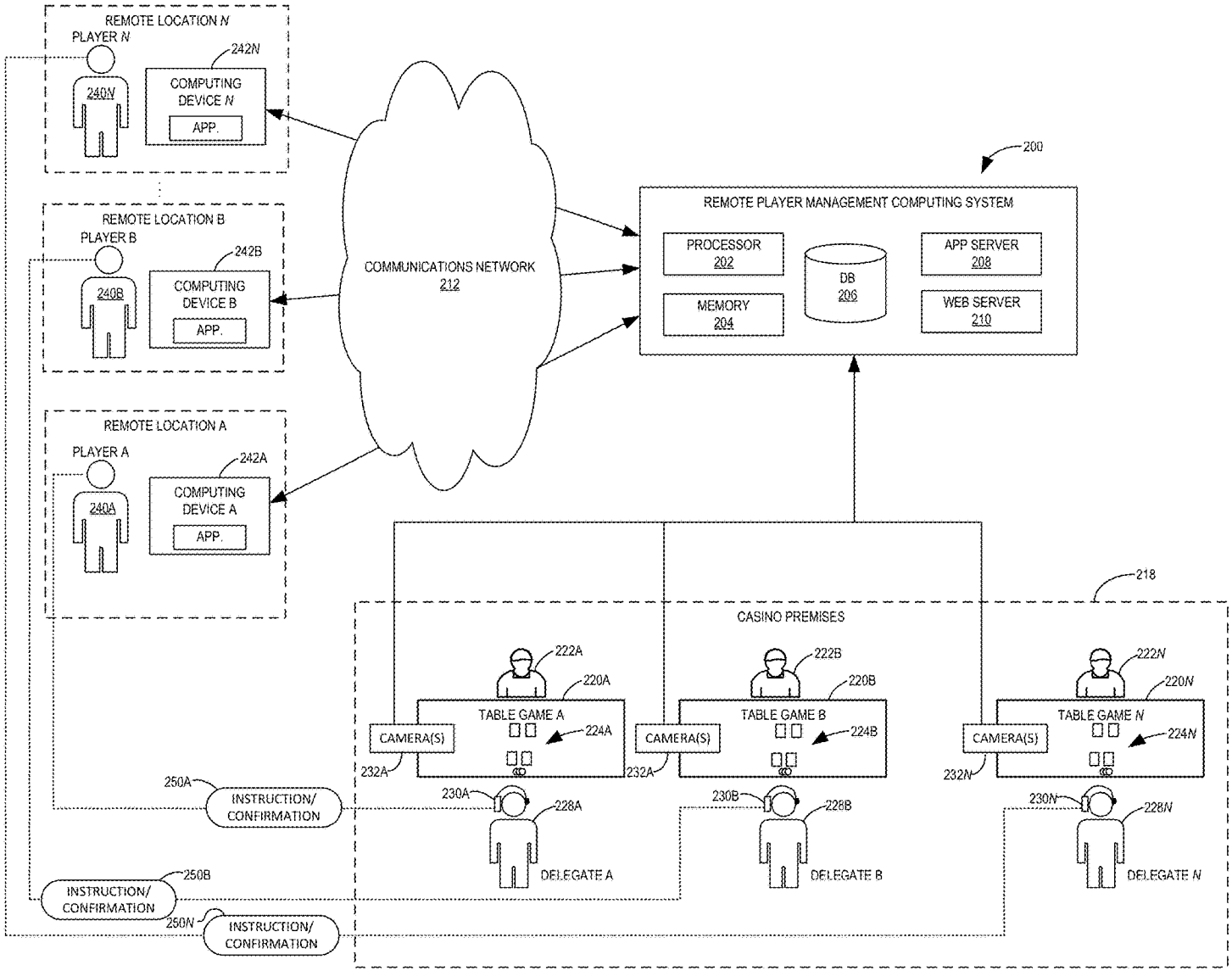
FIG. 2 is an example operational system diagram in accordance with one non-limiting embodiment.

Referring now to FIG. 2, an example operational system diagram is shown in accordance with one non-limiting embodiment. A remote player management computing system 200 can be provided using any suitable processor-based device or system, such as a personal computer, laptop, server, mainframe, or a collection (e.g., network) of multiple computers, for example. The remote player management computing system 200 can include one or more processors 202 and one or more computer memory units 204. For convenience, only one processor 202 and only one memory unit 204 are shown in FIG. 2. The processor 202 can execute software instructions stored on the memory unit 204. The processor 202 can be implemented as an integrated circuit (IC) having one or multiple cores. The memory unit 204 can include volatile and/or non-volatile memory units. Volatile memory units can include random access memory (RAM), for example. Non-volatile memory units can include read only memory (ROM), for example, as well as mechanical non-volatile memory systems, such as, for example, a hard disk drive, an optical disk drive, etc. The RAM and/or ROM memory units can be implemented as discrete memory ICs, for example.

The memory unit 204 can store executable software and data for the remote player management computing system 200. When the processor 202 of the remote player management computing system 200 executes the software, the processor 202 can be caused to perform the various operations of the remote player management computing system 200. Data used by the remote player management computing system 200 can be from various sources, such as a database (s) 206, which can be an electronic computer database, for example. The data stored in the database(s) 206 can be stored in a non-volatile computer memory, such as a hard disk drive, a read only memory (e.g., a ROM IC), or other types of non-volatile memory. In some embodiments, one or more databases 206 can be stored on a remote electronic computer system, for example. As is to be appreciated, a variety of other databases, or other types of memory storage structures, can be utilized or otherwise associated with the remote player management computing system 200.

In accordance with some embodiments, the remote player management computing system 200 is a standalone system, or other collection of resources, that is generally separate from computing systems of a casino operator. In other embodiments, however, the remote player management computing system 200 is a component of, or otherwise implemented by, a casino management computing system or other operator-based computing system. Thus, the present disclosure is not limited to the embodiment illustrated in FIG. 2, but instead is to broadly cover a wide variety of different implementations.

The remote player management computing system 200 can also be in communication with a plurality of players, illustrated as players 240A-N via their user computing devices 242A-N through a communications network 112. The remote player management computing system 200 can communicate with the various user computing devices 242A-N via a number of computer and/or data networks, including the Internet, LANs, WANs, GPRS networks, etc., that can comprise wired and/or wireless communication links.

The computing devices 242A-N can be any type of computer device suitable for communication with the remote player management computing system 200 over the network 212, such as a wearable computing device, a mobile telephone, a tablet computer, a device that is a combination handheld computer and mobile telephone (sometimes referred to as a "smart phone"), a personal computer (such as a laptop computer, netbook computer, desktop computer, and so forth), or any other suitable mobile communications device, such as personal digital assistants (PDA), tablet devices, gaming devices, virtual reality (VR) devices, augmented reality (AR) devices, or media players, for example.

The computing devices 242A-N can, in some embodiments, provide one or more applications allowing the players 240A-N to accomplish one or more specific tasks using the remote player management computing system 200. Applications can include, without limitation, a web browser application (e.g., INTERNET EXPLORER, MOZILLA, FIREFOX, SAFARI, OPERA, NETSCAPE NAVIGATOR), telephone application (e.g., cellular, VoIP, PTT), networking application, messaging application (e.g., e-mail, IM, SMS, MMS), social media applications, and so forth. The computing devices 242A-N can comprise various software programs such as system programs and applications to provide computing capabilities in accordance with the described embodiments. System programs can include, without limitation, an operating system (OS), device drivers, programming tools, utility programs, software libraries, application programming interfaces (APIs), and so forth. Exemplary operating systems can include, for example, a PALM OS, MICROSOFT OS, APPLE OS, ANDROID OS, UNIX OS, LINUX OS, SYMBIAN OS, EMBEDIX OS, Binary Runtime Environment for Wireless (BREW) OS, JavaOS, a Wireless Application Protocol (WAP) OS, and others.

The computing devices 242A-N can include various components for interacting with the remote player management computing system 200. The computing devices 242A-N can include components for use with one or more applications such as a stylus, a touch-sensitive screen, keys (e.g., input keys, preset and programmable hot keys), buttons (e.g., action buttons, a multidirectional navigation button, preset and programmable shortcut buttons), switches, a microphone, speakers, an audio headset, and so forth.

The players 240A-N can interact with the remote player management computing system 200 via a variety of other electronic communications techniques, such as, without limitation, HTTP requests, in-app messaging, and short message service (SMS) messages. The electronic communications can be generated by a specialized application executed on the computing devices 242A-N or can be generated using one or more applications that are generally standard to the computing devices 242A-N. The applications can include, or be implemented as, executable computer program instructions stored on computer-readable storage media such as volatile or non-volatile memory capable of being retrieved and executed by a processor to provide operations for the computing devices 242A-N. In some embodiments, the specialized application can be branded by the gaming operator, for example.

As shown in FIG. 2, the remote player management computing system 200 can include several computer servers and databases. For example, the remote player management computing system 200 can include one or more application servers 208, web servers 210, and/or any other type of servers. For convenience, only one application server 208 and one web server 210 are shown in FIG. 2, although it should be recognized that the disclosure is not so limited. The servers can cause content to be sent to the computing devices 242A-N in any number of formats, such as text-based messages, multimedia message, email messages, smart phone notifications, web pages, and so forth. The servers 208 and 210 can comprise processors (e.g., CPUs), memory units (e.g., RAM, ROM), non-volatile storage systems (e.g., hard disk drive systems), etc. The servers 208 and 210 can utilize operating systems, such as Solaris, Linux, or Windows Server operating systems, for example.

The web server 210 can provide a graphical web user interface through which various users of the system can interact with the remote player management computing system 200. The web server 210 can accept requests, such as HTTP requests, from clients (such as via web browsers on the computing devices 242A-N), and serve the clients responses, such as HTTP responses, along with optional data content, such as web pages (e.g., HTML documents) and linked objects (such as images, video, and so forth).

The application server 208 can provide a user interface for users who do not communicate with the remote player management computing system 200 using a web browser. Such users can have special software installed on their computing devices 242A-N that allows them to communicate with the application server 108 via the network. Such software can be downloaded, for example, from the remote player management computing system 200, or other software application provider, over the network to such computing devices 242A-N.

Still referring to FIG. 2, a casino premises 218 can include a plurality of table games 220A-N. As is to be appreciated, each of the table games 220A-N can be any suitable game type. By way of example, any of the table games 220A-N can be a card game (such as Baccarat, Blackjack, Caribbean stud poker, Casino war, Faro, Flop Poker, Four Card Poker, Let It Ride, Mississippi Stud, Pai Gow Poker, poker, Three Card Poker, and so forth), a dice game (such as Craps, Pai Gow, Sic Bo, Kauda, and so forth), a random number game (such as Big Six wheel, Roulette, and so forth), or a variety of other types of games. The table games 220A-N can include game pieces 224A-N and, as schematically shown, each of the table games 220A-N can be associated with a dealer 222A-N. The type of game pieces 224A-N can vary based on the game, but generally game pieces 224A-N can include, for example, cards, dices, tiles, chips, and so forth.

FIG. 2 also depicts delegates 228A-N positioned at each of the table games 220A-N. While a single delegate is positioned at each table for the sake of illustration, it is to be appreciated that any suitable number of delegates can be positioned at a particular table. Further, in some cases, additional players can also be participating in the gameplay at the table game. Each delegate 228A-N can be associated with communication equipment 230A-N, which is schematically illustrated as a headset, although this disclosure is not so limited. Additionally, camera(s) 232A-N can supply a video feed of each respective table games 220A-N. In some embodiments, the camera(s) 232A-N are temporarily positioned proximate to the table games 220A-N during gaming sessions. As schematically shown, during a gameplay session, communications 250A-N can be facilitated between the players 240A-N and their respective delegates 228A-N.

In accordance with the present disclosure, the players 240A-N can first schedule and reserve a gaming session at a particular type of game for a particular table limit. As provided below with reference to FIG. 3, the players 240A-N first may be required to join a loyalty program, fund a gaming account, and/or take other actions in advance of a gaming session. At the time of the scheduled gaming session, the players 240A-N can access the remote player management computing system 200 using their computing device 242A-N. In accordance with various embodiments, the identity of the players 240A-N can open their reservation and initiate the gaming session. Similarly, around the same time, the delegates 228A-N can retrieve their communication equipment 230A-N, and in some cases, the cameras 232A-N. The operation of the communication equipment 230A-N can be keyed to a particular reservation to ensure that the associated player 240A-Nis connected to the appropriate delegate 228A-N and the reserved table game 220A-N. In some embodiments, for example, each of the delegates 228A-N reports to a specialized area of the casino where the communication equipment 230A-N and cameras 232A-N are stored when not in use. Each delegate 228A-N can be check-in for their assignment, with each assignment tied to a particular reservation for one of the players 240A-N. In some embodiments, each delegate 228A-N then "check-outs" communication equipment and a camera and travels on the casino floor to the particular table 222A-N designated in the reservation. For the purposes of illustration, delegate 228A may be assigned to table 220A at 7 pm, which is a blackjack game with a $100 table limit. Delegate 228B may be assigned to table 220B at 7:30 pm, which is a craps game with a $25 table limit, and so forth.

Once the player 240A-N has initiated the session at their respective computing devices 242A-N and the delegates 228A-N are in position, gameplay can begin. In some embodiments, the respective delegate 228A-N of each player 240A-N can be instructed by their respective player to draw a marker to receive funds for gameplay. The player 240A-N can then instruct the delegate 228A-N to take action via communications 250A-N, such as place a bet of a particular denomination, or perform a particular action in the game occurring in real-time at the table game 220A-N. In some embodiments, an oral instruction is conveyed by the player 240A-N to an earpiece of the communication equipment 230A-N of their respective delegate 228A-N. The delegate 228A-N can, for example, orally confirm the instruction to the player 240A-N and then perform the action as instructed. Through their computing devices 242A-N, each of the players 240A-N can watch the gameplay action in real-time via the feed from the cameras 232A-N positioned at their respective table and, based on the gameplay events, decide in real-time how to instruct their delegate 228A-N.

Moreover, in some embodiments, the game pieces 224A-N can be monitored, tracked, or otherwise detected, so that real-time game piece information can be visually displayed on the computing devices 242A-N along with the real-time livestreaming of the gameplay. Such game piece information can be, for example, card values, dice values, betting amounts, pot amounts, and so forth. Such tracking of game pieces can be performed using any suitable techniques, such as RFID tracking, image recognition, and so forth.

The gaming session can terminate either due to a depletion of funds or a termination instruction by the player. Any chips can be returned to the account of the player 240A-N. Each of the delegates 228A-N can return their respective communication devices 230A-N to a charging rack or other depository within the casino premises 218. Any portable camera(s) 232A-N can be returned as well. Audio and video data of the gaming session can be stored by the remote player management computing system 200 in any suitable data structure for a period of time, such as 2-7 years, for example. Such data can be used for dispute resolution purposes, among other purposes.

Figure 3:
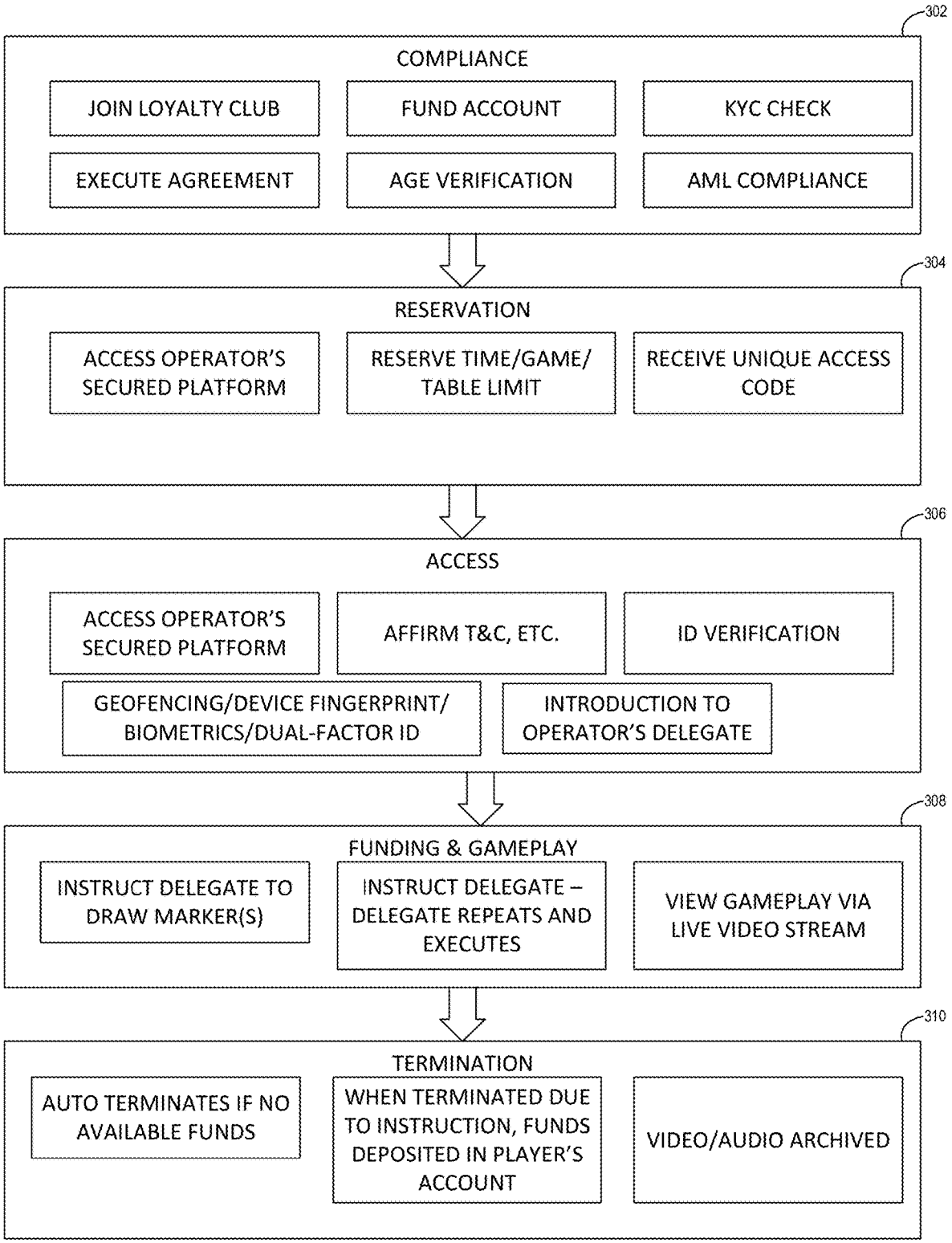
FIG. 3 is an example process flow in accordance with one non-limiting embodiment.

Referring now to FIG. 3, an example process flow in accordance with one non-limiting embodiment is shown. At a compliance step 302, various compliance related tasks can be completed to onboard a player. For example, the player can be required to join a loyalty club of the operator and execute any necessary agreements to participate in the remote gaming program. The player can also be required to fund an account, which will eventually be accessed by a delegate to draw a marker. During the compliance step 302, various processes can be executed as related to Know Your Customer (KYC) and Anti-Money Laundering (AML) compliance.

Next, at a reservation step 304 the player can make a reservation for a gaming session. In some embodiments, such reservations can be made through an online branded reservation system. Such reservation system can be accessed via a mobile application or a web-based interface, for example, the reservation can reserve a particular game at a particular time and at a particular table limit. In some embodiments, the player receives a unique code or other identifier that can be used to access the reservation at the appropriate time.

Next, at an access step 306, the player can access the platform via a suitable computing device. In some embodiments, the player can enter their unique access code as assigned to them during the reservation process. The player can affirm various obligations as related to relevant terms and conditions, responsible gaming, and so forth. In some embodiments, ID or other forms of user verification can be performed at the access step 306. Upon completing the access requirements, the player can access the platform and be introduced to the delegate that is on-premises at the casino.

At a funding and gameplay step 308, gaming can commence. During this step, the player can instruct the delegate to draw an initial marker. Additional markers can be drawn during gameplay. The player can also observe the gameplay via one or more camera feeds and provide instruction. The delegate can repeat the instruction and execute the action indicated by the instruction.

At a termination step 310, the gameplay can conclude. During the termination step, remaining funds can be deposited to the player's account. Additionally, audio, video, and/or other data related to the gaming session can be stored for a period of time.

Figure 8:
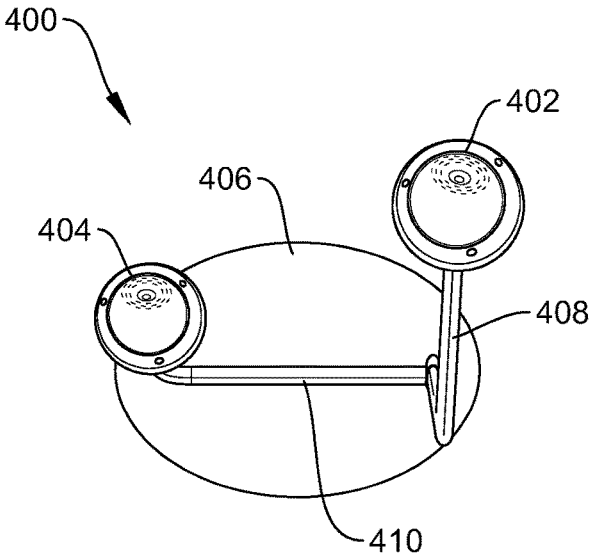
Figure 9:
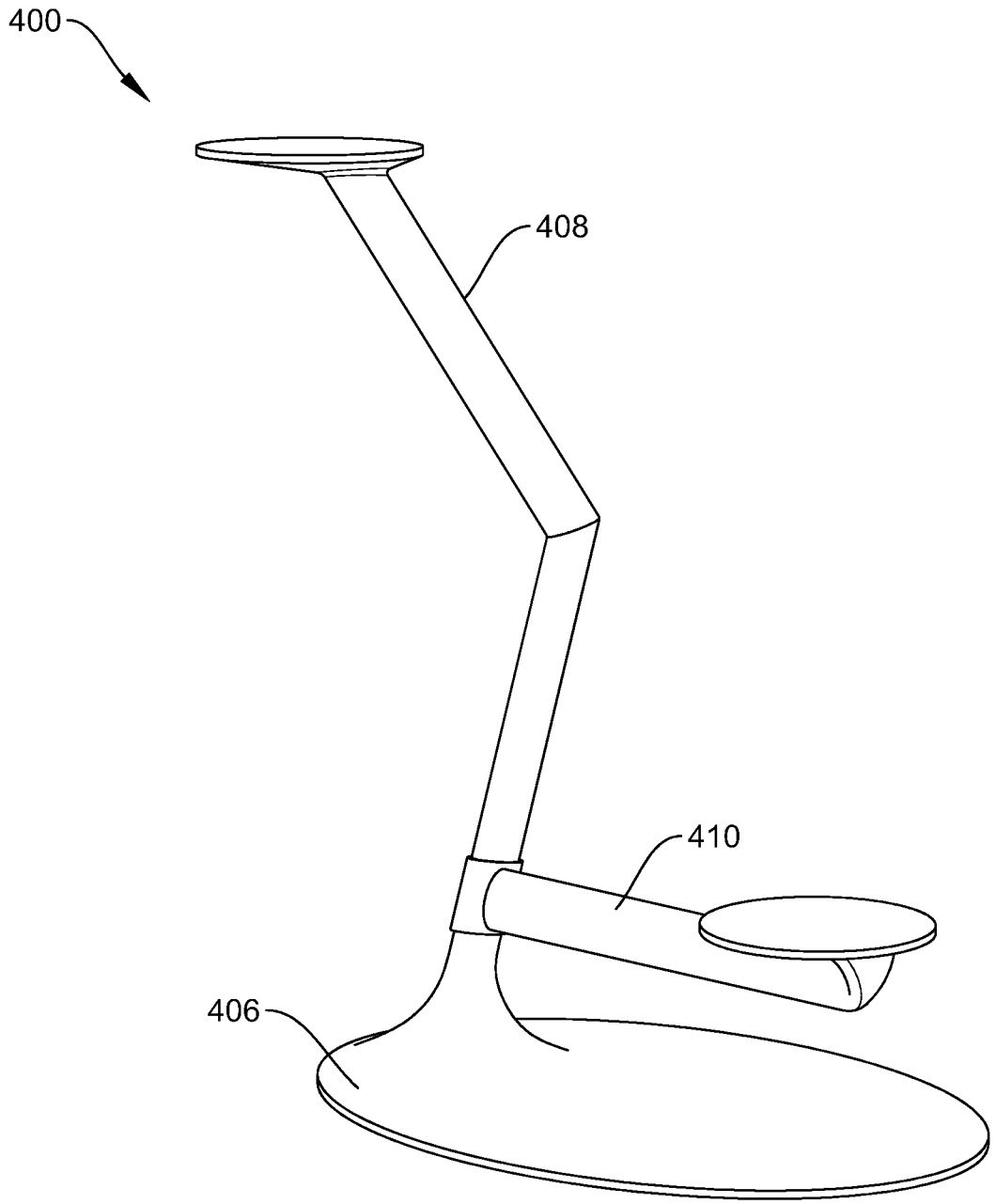

In accordance with various embodiments, tables within a casino environment might be used for conventional gameplay at certain times and delegate-based gameplay at other times. As such, during delegate-based gameplay, additional cameras may need to be used to capture livestreams for viewing by the remote player. While additional cameras can be positioned proximate to the table game using any suitable technique, FIGS. 4-9 depict a camera stand 400 in accordance with one non-limiting embodiment. In particular, FIGS. 4-7 are side views of the camera stand 400, while FIG. 8 is a top view. FIG. 9 shows the camera stand 400 without any cameras. In some embodiments, for example, prior to commencing a gaming session, a delegate can check-out their communication equipment and the camera stand 400 and travel to their designated table. The communication equipment and the camera stand 400 can both be keyed to a particular reservation to ensure the associated player is viewing the correct table game and is in communication with the correct delegate. The camera stand 400 can be placed on the table top, either by the dealer, the delegate, or any other suitable personnel.

In the example embodiment, the camera stand 400 includes a top camera 402 and a bottom camera 404. While the cameras 402 and 404 are shown as dome-type cameras for illustration purposes, any suitable camera type or combination of different came types can be utilized. Moreover, while the example camera stand 400 accommodates two cameras, other embodiments of camera stands can be configured to accommodate a single camera or more than two cameras. Feeds from each of the cameras 402 and 404 can be routed to the computing device of the player that is associated with the delegate at the table. The field of view the top camera 402, can be an "eye level" view of the gameplay, whereas the field of view of the bottom camera 404 can be selected to specifically capture cards, chips, or other gaming pieces. In some embodiments, the cameras 402 and 404 are wireless and the camera stand 400 includes a rechargeable battery pack to aid in portability.

Figure 4:
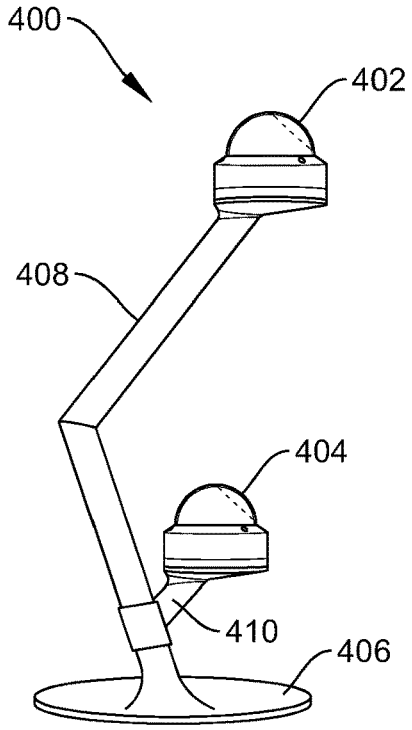
FIGS. 4-9 depict a camera stand in accordance with various non-limiting embodiments.
Figure 5:
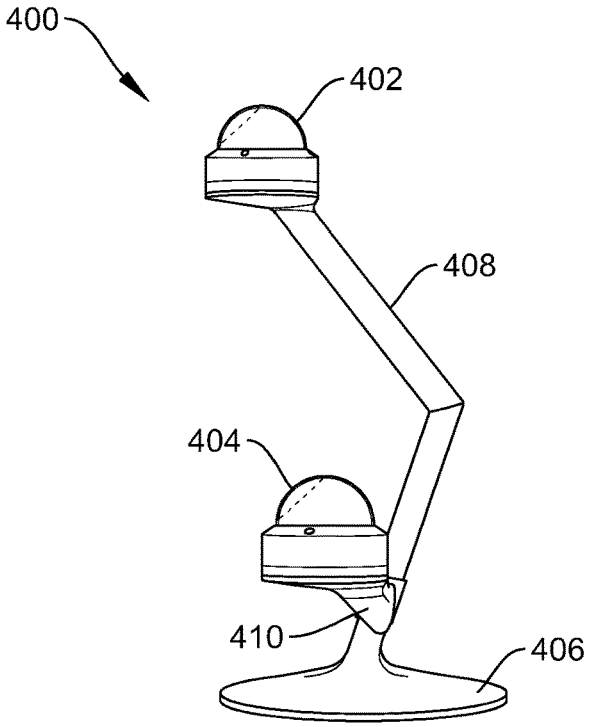
Figure 6:
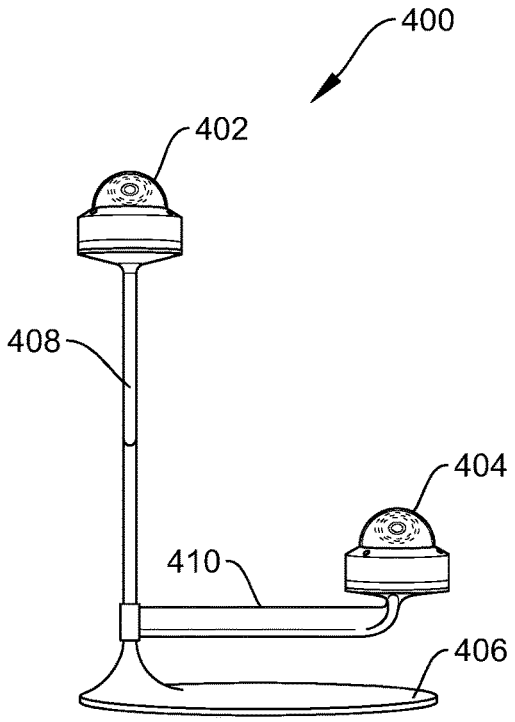
Figure 7:
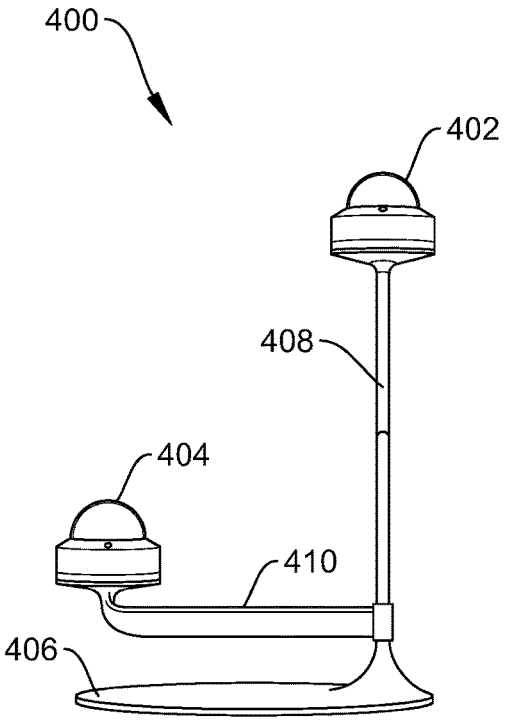

In some embodiments, the camera stand 400 can have a base 406 that is generally elliptical. A vertical arm 408 can extend upwards from the base 406. The top camera 402 can sit atop the vertical arm 408, for example. A horizontal arm 410 can extend laterally from the vertical arm 408. The bottom camera 404 can be coupled to the distal end of the horizontal arm 410. As shown in FIGS. 4-5, the vertical arm 408 can be configured as to not interfere with the field of view of the bottom camera 404.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A remote gameplay communication system, comprising:

a remote player management computing system;

a camera depository for storing a plurality of cameras within a casino premises, wherein each of the plurality of cameras can be checked-out for use;

a wireless headset depository for storing a plurality of wireless headsets within the casino premises, wherein each of the plurality of wireless headsets can be checked-out for use;

a checked-out camera positioned proximate to a gaming table within the casino premises, wherein the checked-out camera is checked-out from the camera depository and provides a video feed of gameplay at the gaming table to the remote player management computing system via network communications;

a checked-out wireless headset worn by a delegate positioned proximate to the gaming table at the casino premises, wherein wireless headset is checked-out from the wireless headset depository and is in networked communication with the remote player management computing system;

wherein the remote player management computing system is in communication with a remote computing device via an application executing on the remote computing device, and the remote player management computing system is configured to:

provide the real-time video feed of gameplay at the gaming table to the remote computing device for display thereon;

receive gaming instructions from the remote computing device via input to the application executing on the remote computing device; and provide the gaming instructions to the checked-out wireless headset operated by the delegate.

2. The remote gameplay communication system of claim 1, wherein each of the plurality of wireless headsets comprises a microphone.

3. The remote gameplay communication system of claim 2, wherein each of the plurality of wireless headsets comprises a speaker.

4. The remote gameplay communication system of claim 3, wherein each of the plurality of wireless headsets is a VOIP wireless headset.

5. The remote gameplay communication system of claim 1, further comprising a portable camera stand temporarily positioned on a surface of the gaming table, wherein the checked-out camera is coupled to the portable camera stand.

6. The remote gameplay communication system of claim 5, wherein the portable camera stand holds at least two checked-out cameras, wherein each of the two checked-out cameras is positioned at a different elevation relative to the surface of the gaming table.

7. The remote gameplay communication system of claim 1, wherein a geographic location of the remote computing device is provided to the remote player management computing system.

8. The remote gameplay communication system of claim 7, wherein the remote computing device is physically positioned external to the casino premises.

9. The remote gameplay communication system of claim 1, further comprising a database archiving the gaming instructions and the video feed of gameplay at the gaming table for at least a period of time.

10. The remote gameplay communication system of claim 1, wherein the gaming instructions comprise an oral instruction.

11. The remote gameplay communication system of claim 1, wherein the remote player management computing system provides real-time game piece information to the remote computing device for display thereon.

12. The remote gameplay communication system of claim 1, wherein the remote player management computing system is configured to:

receive oral confirmation of the gaming instruction spoken by the delegate via the wireless headset operated by the delegate; and provide the oral confirmation to the remote computing device.

13. A remote gameplay communication system, comprising:

a remote player management computing system;

a camera depository for storing a plurality of cameras within a casino premises, wherein each of the plurality of cameras can be checked-out for use;

a wireless headset depository for storing a plurality of wireless headsets within the casino premises, wherein each of the plurality of wireless headsets can be checked-out for use;

a first checked-out camera positioned proximate to a first position at a gaming table within the casino premises, wherein the first checked-out camera provides a first video feed of gameplay at the gaming table to the remote player management computing system via network communications, wherein the first checked-out camera is checked-out from the camera depository;

a second checked-out camera positioned proximate to a second position at the gaming table within the casino premises, wherein the second camera provides a second video feed of gameplay at the gaming table to the remote player management computing system via network communications, wherein the second checked-out camera is checked-out from the camera depository;

a first checked-out wireless headset operated by a first delegate at the first position of the gaming table, wherein the first checked-out wireless headset is in networked communication with the remote player management computing system, wherein the first checked-out wireless headset is checked-out from the wireless headset depository;

a second checked-out wireless headset operated by a second delegate at the second position of the gaming table, wherein the second checked-out wireless headset is in networked communication with the remote player management computing system, wherein the second checked-out wireless headset is checked-out from the wireless headset depository;

wherein the remote player management computing system is in communication with a first remote computing device via an application executing on the first remote computing device;

wherein the remote player management computing system is in communication with a second remote computing device via an application executing on the second remote computing device;

wherein the remote player management computing system is configured to:

provide the first video feed of gameplay at the gaming table to the first remote computing device for display thereon;

provide the second video feed of gameplay at the gaming table to the second remote computing device for display thereon;

receive first gaming instructions from the first remote computing device via input to the application executing on the first remote computing device;

provide the first gaming instructions to the first checked-out wireless headset; and receive second gaming instructions from the second remote computing device via input to the application executing on the second remote computing device; and provide the second gaming instructions to the second checked-out wireless headset.

14. The remote gameplay communication system of claim 13, wherein each of the first checked-out wireless headset and second checked-out wireless headset comprises a microphone and a speaker.

15. The remote gameplay communication system of claim 13, further comprising a first portable camera stand positioned on a surface of the gaming table and a second portable camera stand positioned on the surface of the gaming table, wherein the first checked-out camera is coupled to the first portable camera stand and the second checked-out camera is coupled to the second portable camera stand.

16. The remote gameplay communication system of claim 15, further comprising a third checked-out camera coupled to the first portable camera stand and a fourth checked-out camera coupled to the second portable camera stand, wherein each of the third checked-out camera and the fourth checked-out camera provides respective video feeds of gameplay at the gaming table to the remote player management computing system via network communications, wherein the third checked-out camera is at a different elevation than the first checked-out camera relative to the surface of the gaming table, and wherein the fourth checked-out camera is at a different elevation than the second checked-out camera relative to the surface of the gaming table.

17. The remote gameplay communication system of claim 13, wherein a geographic location of the first remote computing device is detected and wherein a geographic location of the second remote computing device is detected.

18. The remote gameplay communication system of claim 17, wherein the first video feed of gameplay at the gaming table is only provided to the first remote computing device if the geographic location of the first remote computing device satisfies a geographic parameter and wherein the second video feed of gameplay at the gaming table is only provided to the second remote computing device if the geographic location of the second remote computing device satisfies the geographic parameter.

19. A computer-based method of remote gameplay management, comprising:

associating, by a remote player management computing system, a checked-out camera and a checked-out wireless headset to a reservation for gameplay by a remote player at a casino premises, wherein the checked-out wireless headset is checked-out of a depository of wireless headsets at the casino premises by a delegate, and wherein the checked-out camera is checked-out of a depository of cameras at the casino premises by the delegate;

receiving, by a remote player management computing system, a video feed of live gameplay at a gaming table located at the casino premises, wherein the video feed is captured by the checked-out camera positioned at the gaming table;

providing, by the remote player management computing system, the video feed of the live gameplay at the gaming table to a remote computing device of the remote player for display thereon;

receiving, by the remote player management computing system, a gaming instruction from the remote computing device, wherein the game instruction is provided by the remote player that is not physically located at the gaming table; and providing, by the remote player management computing system, the gaming instruction to the checked-out wireless headset, wherein the checked-out wireless headset is worn by the delegate at to the gaming table.

20. The computer-based method of remote gameplay management of claim 19, further comprising:

presenting, by the remote player management computing system, a reservation and scheduling interface on the remote computing device;

scheduling, by the remote player management computing system, the reservation for the remote player, wherein the reservation indicates a type of game, a table limit, and start time for the gaming session.

* * * * *